US010706995B1

(12) United States Patent
Uchida

(10) Patent No.: US 10,706,995 B1
(45) Date of Patent: Jul. 7, 2020

(54) CHIP VARISTOR

(71) Applicant: TDK CORPORATION, Tokyo (JP)

(72) Inventor: Masayuki Uchida, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 16/710,194

(22) Filed: Dec. 11, 2019

(30) Foreign Application Priority Data

Dec. 12, 2018 (JP) ..... 2018-232715

(51) Int. Cl.
*H01C 7/12* (2006.01)
*H01C 1/14* (2006.01)

(52) U.S. Cl.
CPC ..... *H01C 7/12* (2013.01); *H01C 1/14* (2013.01)

(58) Field of Classification Search
CPC ..... H01C 7/12; H01C 1/14; H01C 17/28
See application file for complete search history.

(56) References Cited

U.S. PATENT DOCUMENTS 5,793,601 A * 8/1998 Nakamura ..... H01C 7/1006 361/321.4
7,754,109 B2 * 7/2010 Yoshida ..... C04B 35/453 252/519.15
7,994,893 B2 * 8/2011 Matsuoka ..... C04B 35/453 338/20
8,410,891 B2 * 4/2013 Feichtinger ..... H01C 7/10 338/20
8,471,673 B2 * 6/2013 Tanaka ..... H01C 1/14 29/610.1
10,074,465 B2 * 9/2018 Hirata ..... H01C 17/281
2004/0169267 A1 * 9/2004 Matsuoka ..... H01C 1/146 257/684
2007/0091532 A1 * 4/2007 Yamauchi ..... H01C 1/148 361/118
2008/0238605 A1 * 10/2008 Yoshida ..... H01C 7/1006 338/21
2009/0021340 A1 * 1/2009 Koyama ..... H01C 7/112 338/20

FOREIGN PATENT DOCUMENTS

JP 2002-184608 A 6/2002

* cited by examiner

*Primary Examiner* — Kyung S Lee
(74) *Attorney, Agent, or Firm* — Oliff PLC

(57) ABSTRACT

A chip varistor includes two functional layers (that is, a first functional layer and a second functional layer) inside an element body, and the two functional layers have substantially the same electrostatic capacitance. In the chip varistor, the element body is made highly resistive from an outer surface due to alkali metal containing portion. However, the alkali metal containing portion does not reach the first functional layer and the second functional layer. Therefore, the alkali metal containing portion curbs a parasitic capacitance of the chip varistor without affecting the electrostatic capacitances of the first functional layer and the second functional layer. Accordingly, the chip varistor includes the two functional layers in which variations in capacitance are curbed.

6 Claims, 8 Drawing Sheets

*Fig.7*

| SAMPLE | CONDUCTOR WIDTH C [mm] | ELEMENT BODY DIMENSIONS C' [mm] | RATIO C/C' | VARISTOR VOLTAGE [V] | ESD TOLERANCE [kV] | DETERMINATION |
|---|---|---|---|---|---|---|
| 1 | 0.06 | 1.20 | 5% | 26.0 | 16 | × |
| 2 | 0.1 | 1.21 | 8% | 26.2 | 30 | ○ |
| 3 | 0.2 | 1.20 | 17% | 27.4 | 30 | ○ |
| 4 | 0.4 | 1.20 | 33% | 26.7 | 30 | ○ |
| 5 | 0.6 | 1.20 | 50% | 27.2 | 30 | ○ |
| 6 | 0.7 | 1.21 | 58% | 27.1 | 30 | ○ |
| 7 | 0.8 | 1.20 | 67% | 41.4 | 4 | × |
| 8 | 0.9 | 1.21 | 74% | 81.5 | 2 | × |

*Fig.8*

| SAMPLE | CONDUCTOR WIDTH D [mm] | TERMINAL ELECTRODE WIDTH D' [mm] | RATIO D/D' | VARISTOR VOLTAGE [V] | ESD TOLERANCE [kV] | DETERMINATION |
|---|---|---|---|---|---|---|
| 1 | 0.03 | 0.36 | 8% | 26.9 | 2 | × |
| 2 | 0.06 | 0.35 | 17% | 26.2 | 12 | × |
| 3 | 0.1 | 0.36 | 28% | 26.3 | 30 | ○ |
| 4 | 0.12 | 0.36 | 33% | 27.0 | 30 | ○ |
| 5 | 0.16 | 0.35 | 46% | 27.1 | 30 | ○ |
| 6 | 0.18 | 0.35 | 51% | 26.7 | 30 | ○ |
| 7 | 0.2 | 0.36 | 56% | 27.5 | 30 | ○ |
| 8 | 0.24 | 0.35 | 69% | 22.1 | 30 | × |
| 9 | 0.3 | 0.36 | 83% | 19.7 | 30 | × |

CHIP VARISTOR

CROSS-REFERENCE TO RELATED APPLICATIONS

This application is based upon and claims the benefit of priority from Japanese Patent Applications No. 2018-232715, filed on 12 Dec. 2018, the entire content of which is incorporated herein by reference.

TECHNICAL FIELD

The present disclosure relates to a chip varistor.

BACKGROUND

Regarding chip varistors, laminated chip varistors including a varistor element body that has a functional layer (varistor layer) and internal electrodes disposed to be in contact with the functional layer such that the functional layer is sandwiched therebetween, and terminal electrodes that are disposed to be connected to the internal electrodes corresponding to end portions of the varistor element body are known (for example, refer to Japanese Unexamined Patent Publication No. 2002-184608).

SUMMARY

For example, the inventors have repeated research on a technology of applying a chip varistor to a differential transmission transceiver in order to protect a vehicle-mounted differential transmission transceiver from a surge voltage such as an electrostatic discharge (ESD). As a result, the inventors have achieved the knowledge that variations in capacitance between chip varistors respectively attached to two channels may cause a communication error.

As a result of intensive research, the inventors newly found a technology in which signal errors can be reduced by curbing variations in capacitance.

The present disclosure provides a chip varistor and a differential transmission transceiver, in which high signal accuracy can be realized.

According to an aspect of the present disclosure, there is provided a chip varistor including an element body having a first surface and a second surface facing each other and having a laminated structure; a first conductor extending within a predetermined layer of the element body in a facing direction, the first surface and the second surface face each other in the facing direction; a second conductor extending within a layer different from the layer of the first conductor of the element body in the facing direction, and forming a superposition portion superposed on the first conductor in a lamination direction of the element body; a third conductor extending within a layer positioned in the middle between the first conductor and the second conductor of the element body in a direction intersecting the first conductor and the second conductor, having a functional portion superposed on the superposition portion in the lamination direction of the element body, forming a first functional layer between the functional portion and the first conductor, and forming a second functional layer between the functional portion and the second conductor; a first electrode provided on the first surface side of the element body and connected to the first conductor; a second electrode provided on the second surface side of the element body and connected to the second conductor; a third electrode provided on a surface of the element body and connected to the third conductor; and an alkali metal containing portion serving as a part of the element body, an electrical resistance of the alkali metal containing portion has been enhanced due to an alkali metal being contained, the alkali metal containing portion constituting the surface of the element body, and the alkali metal containing portion extending inward from the surface of the element body along interfaces between the first conductor, the second conductor, and the third conductor, and the element body. The alkali metal containing portion does not reach the first functional layer and the second functional layer.

The chip varistor includes two functional layers (that is, the first functional layer and the second functional layer) inside the element body. The first functional layer and the second functional layer are formed when the functional portion of the third conductor is superposed on each of the first conductor and the second conductor in the superposition portion in which the first conductor and the second conductor are superposed on each other. Therefore, a facing area of the functional portion of the third conductor and the first conductor, and a facing area of the functional portion of the third conductor and the second conductor are made identical to each other. Moreover, in the chip varistor, a part of the element body excluding the first functional layer and the second functional layer is made highly resistive due to the alkali metal containing portion. Therefore, a parasitic capacitance which may be generated between any two of the first conductor, the second conductor, the third conductor, the first electrode, the second electrode, and the third electrode is curbed. Accordingly, the chip varistor includes two functional layers in which variations in capacitance are curbed, and the functional layers are applied to a differential transmission transceiver. Thus, high signal accuracy can be realized.

In the chip varistor according to the aspect, a distance from a position the alkali metal containing portion reaches along the interface between the first conductor and the element body to the superposition portion and a distance from the position the alkali metal containing portion reaches along the interface between the second conductor and the element body to the superposition portion may be longer than a distance from the position the alkali metal containing portion reaches along the interface between the third conductor and the element body to the superposition portion.

In the chip varistor according to the aspect, in a direction orthogonal to the lamination direction and the facing direction of the first surface and the second surface, a ratio of a length of the first conductor and a length of the second conductor to a length of the element body may be within a range of 0.1 to 0.6. In this case, the chip varistor has high ESD resistance and has high reliability.

In the chip varistor according to the aspect, in the facing direction of the first surface and the second surface, a ratio of a length of the third conductor to a length of the third electrode may be within a range of 0.2 to 0.6. In this case, the chip varistor has high ESD resistance and has high reliability.

In the chip varistor according to the aspect, in the facing direction of the first surface and the second surface, a length of the functional portion of the third conductor is shorter than a length of the superposition portion.

According to another aspect of the present disclosure, there is provided a differential transmission transceiver including the chip varistor described above. The first electrode of the chip varistor is connected to one channel, the second electrode is connected to the other channel, and the third electrode is earthed. A chip varistor including two functional layers in which variations in capacitance are curbed is applied to the differential transmission transceiver. Thus, high signal accuracy can be realized.

BRIEF DESCRIPTION OF THE DRAWINGS

FIG. 7 is a table showing measurement results and determination results of an experiment using a plurality of samples in which a first conductor and a second conductor are varied in width.

FIG. 8 is a table showing measurement results and determination results of an experiment using a plurality of samples in which a third conductor is varied in width.

DETAILED DESCRIPTION

Figure 1:
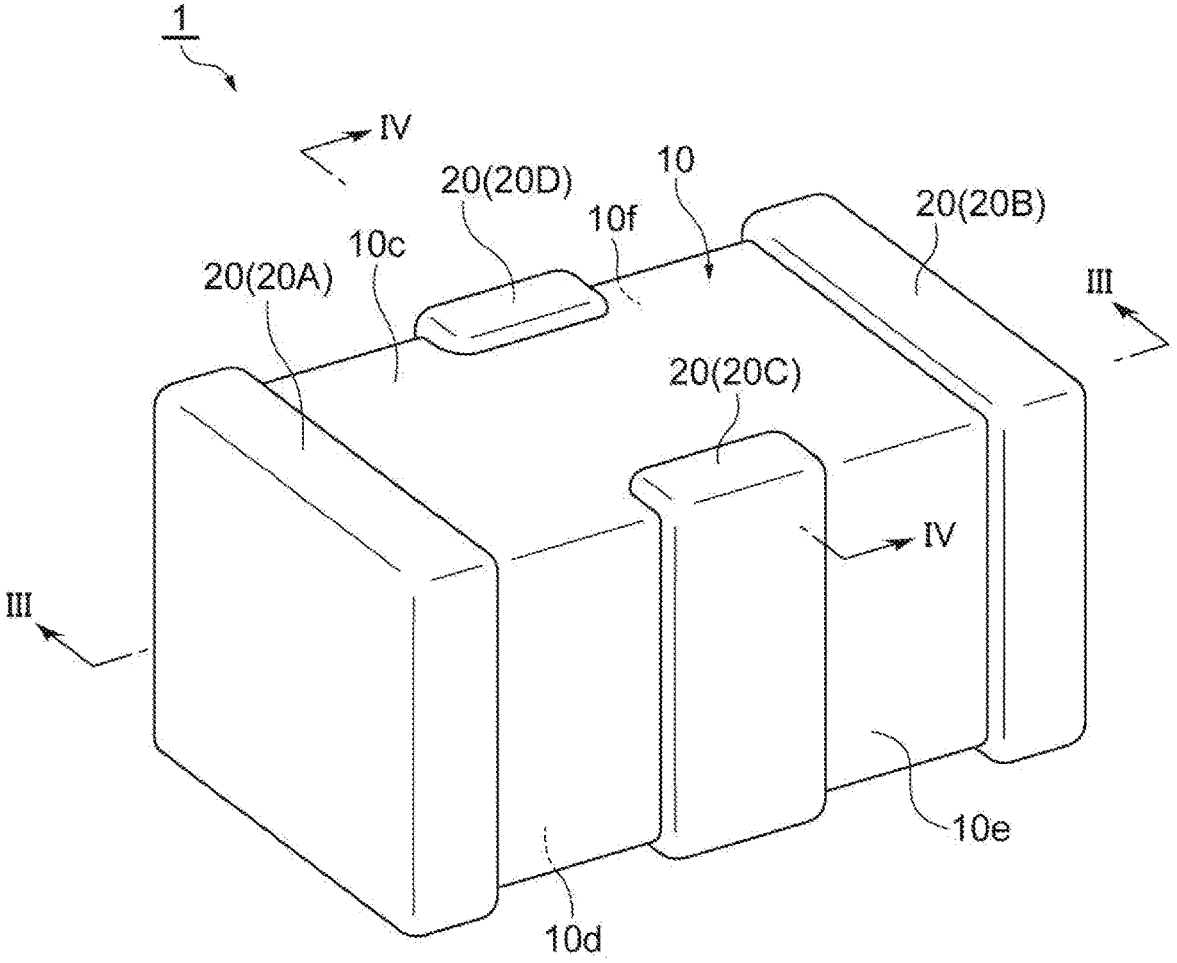
FIG. 1 is a schematic perspective view illustrating a chip varistor according to an embodiment.

Hereinafter, an embodiment of the present disclosure will be described in detail with reference to the accompanying drawings. In the description, the same reference signs are applied to the same elements or elements having the same function, and duplicate description will be omitted.

First, with reference to FIGS. 1 to 4, a constitution of a chip varistor 1 according to the embodiment will be described.

The chip varistor 1 is a three-terminal laminated chip varistor and is configured to include an element body 10 and a terminal electrode 20. The chip varistor 1 has a substantially rectangular parallelepiped external shape with a so-called 2012 size (the length in the longitudinal direction is 2.0 mm, the length in the short direction is 1.25 mm, and the height is 0.5 mm).

The element body 10 is a laminated structure having a substantially rectangular parallelepiped external shape. The element body 10 has square end surfaces 10*a* and 10*b* facing each other in the longitudinal direction, and four rectangular side surfaces 10*c* to 10*f* orthogonal to the end surfaces 10*a* and 10*b*. The four side surfaces 10*c* to 10*f* extend such that the end surfaces 10*a* and 10*b* are joined to each other.

The element body 10 is constituted of a sintered body (semiconductor ceramic) manifesting varistor characteristics. The element body 10 is a laminated structure constituted of a plurality of layers formed of sintered bodies manifesting varistor characteristics. In an actual element body 10, the constituent layers are integrated to the extent that boundaries therebetween cannot be visually recognized. The element body 10 includes ZnO (zinc oxide) as a main component and single material metals such as Co, rare earth metal elements, Group IIIb elements (B, Al, Ga, and In), Si, Cr, Mo, alkali metal elements (K, Rb, and Cs), alkaline earth metal elements (Mg, Ca, Sr, and Ba), or oxides thereof as accessory components. In the present embodiment, the element body 10 includes Co, Pr, Cr, Ca, K, and Al as accessory components. The ZnO content in the element body 10 is not particularly limited. However, when the entire material constituting the element body 10 is 100 mass %, the ZnO content is generally within a range of 99.8 to 69.0 mass %. Rare earth metal elements (for example, Pr) act as substances manifesting varistor characteristics. The rare earth metal element content in the element body 10 is set within a range of approximately 0.01 to 10 atom %, for example.

The chip varistor 1 includes a first conductor 32, a second conductor 34, and a third conductor 36 inside the element body 10. The first conductor 32, the second conductor 34, and the third conductor 36 include a conductive material. A conductive material included in each of the conductors 32, 34, and 36 is not particularly limited. However, the conductive material may be formed of Pd or a Ag—Pd alloy. The thickness (length in a lamination direction) of each of the conductors 32, 34, and 36 is within a range of approximately 0.1 to 10 μm, for example.

The first conductor 32 has a belt shape with a uniform width and extends in the facing direction of the end surfaces 10*a* and 10*b* within a layer constituting the element body 10. In the first conductor 32, one end portion 32*a* is exposed to the end surface 10*a* (first surface), and the other end portion 32*b* is positioned inside the element body 10. The width of the first conductor 32 is 0.4 mm, for example.

The second conductor 34 has a belt shape with a uniform width and extends in the facing direction of the end surfaces 10*a* and 10*b* within a layer different from the layer in which the first conductor 32 is formed. In the second conductor 34, one end portion 34*a* is exposed to the end surface 10*b* (second surface) and the other end portion 34*b* is positioned inside the element body 10. The width of the second conductor 34 is designed to be the same as the width of the first conductor 32, which is 0.4 mm, for example.

Figure 2:
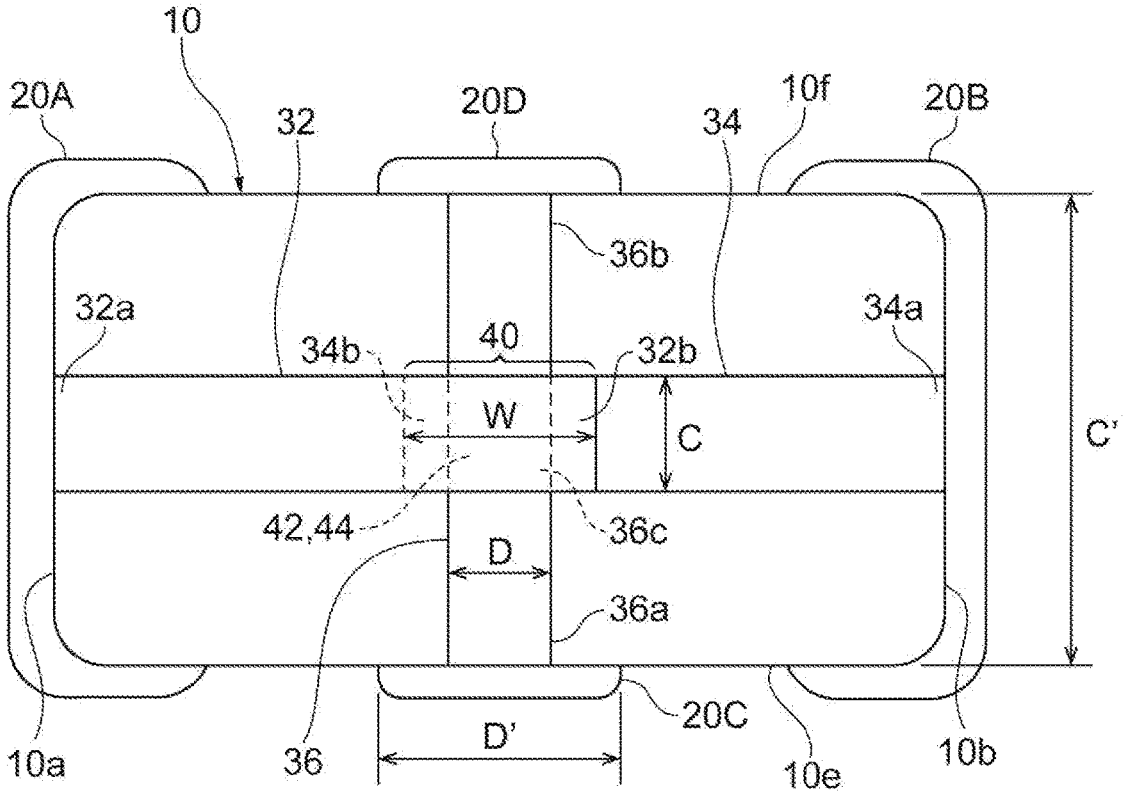
FIG. 2 is a view illustrating each of conductors and each of terminal electrodes of the chip varistor illustrated in FIG. 1.

As illustrated in FIG. 2, the first conductor 32 and the second conductor 34 are positionally aligned with each other when viewed in the lamination direction of the element body 10 (facing direction of the side surface 10*c* and the side surface 10*d*), and the end portions 32*b* and 34*b* positioned inside the element body 10 are completely superposed on each other in the lamination direction. A superposition portion 40 formed by the end portion 32*b* of the first conductor 32 and the end portion 34*b* of the second conductor 34 superposed on each other exhibits a rectangular shape in which the long side direction is parallel to the facing direction of the end surfaces 10*a* and 10*b* when viewed in the lamination direction.

The third conductor 36 has a belt shape with a uniform width and extends within a layer positioned between the first conductor 32 and the second conductor 34. Therefore, in the lamination direction of the element body 10, the separation distance between the third conductor 36 and the first conductor 32 is substantially the same as the separation distance between the third conductor 36 and the second conductor 34. In addition, the third conductor 36 extends in the direction in which the side surfaces 10*e* and 10*f* face each other and intersects (is orthogonal to, in the present embodiment) the first conductor 32 and the second conductor 34 when viewed in the lamination direction of the element body 10. One end portion 36*a* of the third conductor 36 is exposed to the side surface 10*e*, and the other end portion 36*b* of the third conductor 36 is exposed to the side surface 10*f*. The width of the third conductor 36 is narrower than the length of the long side of the superposition portion 40, which is 0.12 mm, for example.

In addition, the third conductor 36 has a functional portion 36*c* superposed on the superposition portion 40 in the lamination direction of the element body. The third conductor 36 is superposed on the first conductor 32 in only the superposition portion 40 and is also superposed on the second conductor 34 in only the superposition portion 40. Therefore, the area of the functional portion 36*c* coincides with a superposition area between the third conductor 36 and the first conductor 32 and also coincides with a superposition area between the third conductor 36 and the second conductor 34.

The functional portion 36*c* forms a first functional layer 42 between the functional portion 36*c* and the end portion 32*b* of the first conductor 32. The first functional layer 42 is an element body part sandwiched between the functional portion 36*c* and the end portion 32*b* of the first conductor 32. The first functional layer 42 has an electrostatic capacitance within a range of approximately 20 to 50 pF, for example. In addition, the functional portion 36*c* forms a second functional layer 44 between the functional portion 36*c* and the end portion 34*b* of the second conductor 34. That is, the second functional layer 44 is an element body part sandwiched between the functional portion 36*c* and the end portion 34*b* of the second conductor 34. As described above, the third conductor 36 is separated from the first conductor 32 and the second conductor 34 by substantially the same distance, and the third conductor 36 has substantially the same superposition areas with respect to the first conductor 32 and the second conductor 34. Therefore, the second functional layer 44 has substantially the same electrostatic capacitance as the electrostatic capacitance of the first functional layer 42.

A first electrode 20A of the terminal electrode 20 is disposed on the end surface 10*a* side of the element body 10. The first electrode 20A is formed to cover the end surface 10*a* and parts of the four side surfaces 10*c* to 10*f* near the end surface 10*a*. The first electrode 20A is also formed to cover the one end portion 32*a* of the first conductor 32 exposed to the end surface 10*a* of the element body 10, and the first electrode 20A is directly connected to the first conductor 32.

A second electrode 20B of the terminal electrode 20 is disposed on the end surface 10*b* side of the element body 10. The second electrode 20B is formed to cover the end surface 10*b* and parts of the four side surfaces 10*c* to 10*f* near the end surface 10*b*. The second electrode 20B is also formed to cover the one end portion 34*a* of the second conductor 34 exposed to the end surface 10*b* of the element body 10, and the second electrode 20B is directly connected to the second conductor 34.

Third electrodes 20C and 20D of the terminal electrode 20 make a pair and are disposed respectively on the side surface 10*e* side and the side surface 10*f* side of the element body 10. Specifically, the third electrode 20C extends in the lamination direction and wraps around the side surface 10*c* and the side surface 10*d* at an intermediate position of the long side of the side surface 10*e* having a rectangular shape. The third electrode 20D extends in the lamination direction and wraps around the side surface 10*c* and the side surface 10*d* at an intermediate position of the long side of the side surface 10*f* having a rectangular shape. The third electrodes 20C and 20D are also formed to respectively cover both end portions 36*a* and 36*b* of the third conductor 36 exposed to the side surfaces 10*e* and 10*f* of the element body 10, and the third electrodes 20C and 20D are directly connected to the third conductor 36.

Each of the electrodes 20A to 20D may have a single layer structure or may have a multi-layer structure. Each of the electrodes 20A to 20D is a baked electrode, for example, and is formed by applying a conductive paste to a surface of the element body 10 and baking it. As a conductive paste, a paste in which a glass component, an organic binder, and an organic solvent are mixed with a powder formed of a metal (for example, Pd, Cu, Ag, or a Ag—Pd alloy) is used. A plated layer can also be formed on such a baked electrode. A plated layer may include a Ni-plated layer and a Sn-plated layer formed on the Ni-plated layer.

Figure 3:
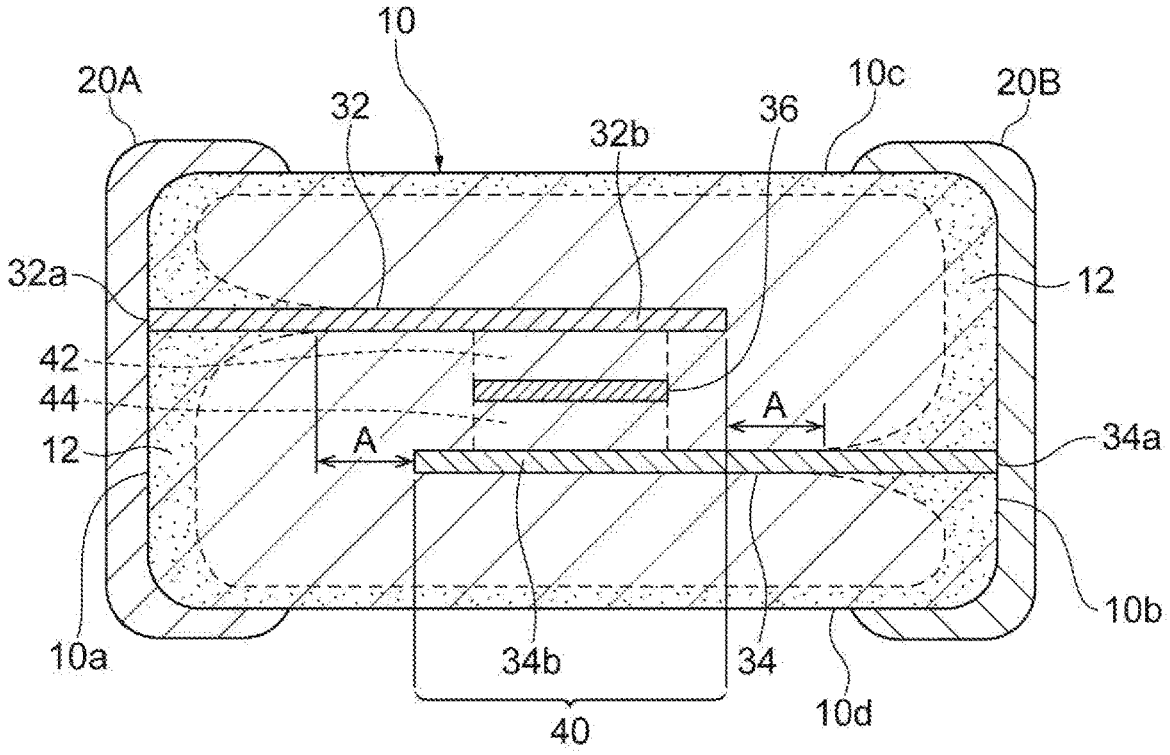
FIG. 3 is a cross-sectional view of the chip varistor illustrated in FIG. 1 taken along line III-III.
Figure 4:
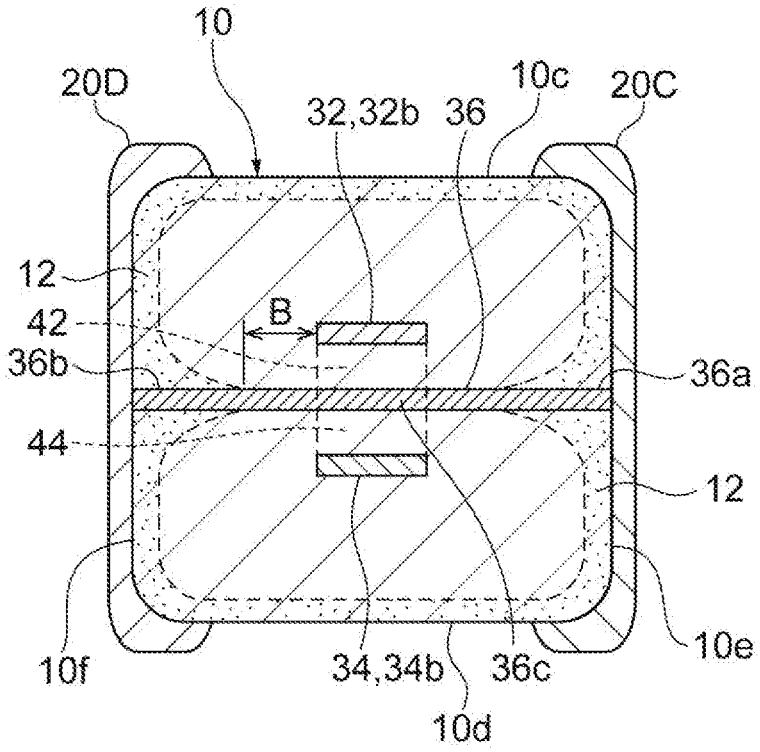
FIG. 4 is a cross-sectional view of the chip varistor illustrated in FIG. 1 taken along line IV-IV.

As illustrated in FIGS. 3 and 4, the element body 10 has an alkali metal containing portion 12 in which an electrical resistance has been enhanced due to alkali metals being contained. The alkali metal containing portion 12 is provided along the entire outer surfaces 10*a* to 10*f* and constitutes the outer surfaces 10*a* to 10*f* of the element body 10. In addition, the alkali metal containing portion 12 also extends inside from the outer surfaces 10*a* to 10*f* of the element body 10 along interfaces between the first conductor 32, the second conductor 34, and the third conductor 36, and the element body 10. However, the alkali metal containing portion 12 is designed such that it does not reach the first functional layer 42 and the second functional layer 44.

Alkali metals are present in the alkali metal containing portion 12. Alkali metals are present inside crystal grains of ZnO in a solid solution state or are present in crystal grain boundaries of ZnO. When there are alkali metals inside crystal grains of ZnO in a solid solution state, donors are reduced due to the alkali metals in ZnO exhibiting properties as an n-type semiconductor, so that electrical conductivity declines and it is difficult to manifest varistor characteristics. It is thought that the electrical conductivity also declines when alkali metals are present in crystal grain boundaries of ZnO. Accordingly, compared to a part other than the alkali metal containing portion 12 in the element body 10, the alkali metal containing portion 12 has low electrical conductivity and a low electrostatic capacitance as well.

The alkali metal containing portion 12 can be formed as follows. Regarding a method for manufacturing the chip varistor 1 excluding a process of forming the alkali metal containing portion 12 which is made highly resistive, a known process used in a method for manufacturing a laminated chip varistor can be utilized. Therefore, detailed description will be omitted herein.

After the element body 10 is obtained, alkali metals (for example, Li or Na) diffuse from outer surfaces (pair of end surfaces 10*a* and 10*b* and the four side surfaces 10*c* to 10*f*) of the element body 10.

First, an alkali metal compound is adhered to the outer surfaces of the element body 10. An alkali metal compound can be adhered using a closed rotary pot. An alkali metal compound is not particularly limited. However, compounds in which alkali metals can diffuse from a surface of the element body 10 through heat treatment, such as alkali metal oxides, hydroxides, chlorides, nitrates, borates, carbonates, or oxalates, is used.

Further, the element body 10 to which this alkali metal compound is adhered is subjected to heat treatment in an electric furnace at a predetermined temperature for a predetermined time. As a result, alkali metals diffuse inward from the alkali metal compound through the outer surface of the element body 10. As an example, the heat treatment temperature is within a range of 700 to 1,000° C., and the heat treatment atmosphere is ambient air. The heat treatment time (retention time) is within a range of 10 minutes to 4 hours, as an example.

A part in which alkali metal elements diffuse into the element body 10, that is, the alkali metal containing portion 12 is made highly resistive and has a low electrostatic capacitance as described above. In the present embodiment, although alkali metal elements diffuse through the end surfaces 10*a* and 10*b* and the side surfaces 10*e* and 10*f*, since each of the conductors 32, 34, and 36 is exposed to the end surfaces 10*a* and 10*b* and the side surfaces 10*e* and 10*f* which it corresponds to, there is no hindrance in electrical connection between each of the electrodes 20A to 20D and each of the conductors 32, 34, and 36.

As described above, the chip varistor 1 includes two functional layers (that is, the first functional layer 42 and the second functional layer 44) inside the element body 10. Further, the two functional layers 42 and 44 have substantially the same electrostatic capacitance. Moreover, in the chip varistor 1, the element body 10 is made highly resistive through the outer surfaces 10*a* to 10*f* due to the alkali metal containing portion 12, but the alkali metal containing portion 12 does not reach the first functional layer 42 and the second functional layer 44. Therefore, the alkali metal containing portion 12 curbs a parasitic capacitance (that is, a capacitance which may be generated between any two of the first conductor 32, the second conductor 34, the third conductor 36, the first electrode 20A, the second electrode 20B, and the third electrodes 20C and 20D, except for the first functional layer 42 and the second functional layer 44) of the chip varistor 1 without affecting the electrostatic capacitance of the first functional layer 42 and the second functional layer 44. Accordingly, the chip varistor 1 includes the two functional layers 42 and 44 in which variations in capacitance are curbed.

Figure 5:
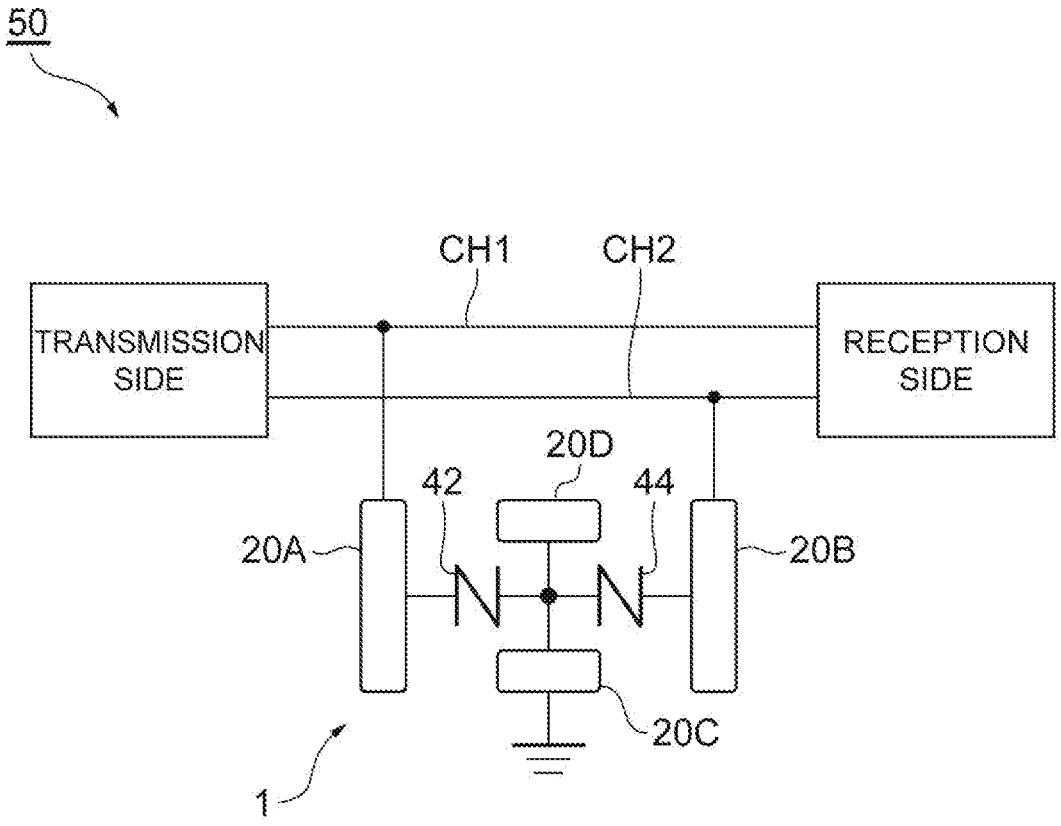
FIG. 5 is a view illustrating a differential transmission transceiver according to another embodiment.

The chip varistor 1 may be applied to a differential transmission transceiver 50 in a form illustrated in FIG. 5. The differential transmission transceiver 50 includes two channels CH1 and CH2 between a transmission side and a reception side. The first electrode 20A of the chip varistor 1 is connected to one channel CH1, the second electrode 20B is connected to the other channel CH2, and both the third electrodes 20C and 20D are earthed. In the differential transmission transceiver 50, since variations in capacitance of the two functional layers 42 and 44 of the chip varistor 1 are curbed, communication errors caused by variations in capacitance are reduced, and thus high signal accuracy can be realized.

Figure 6:
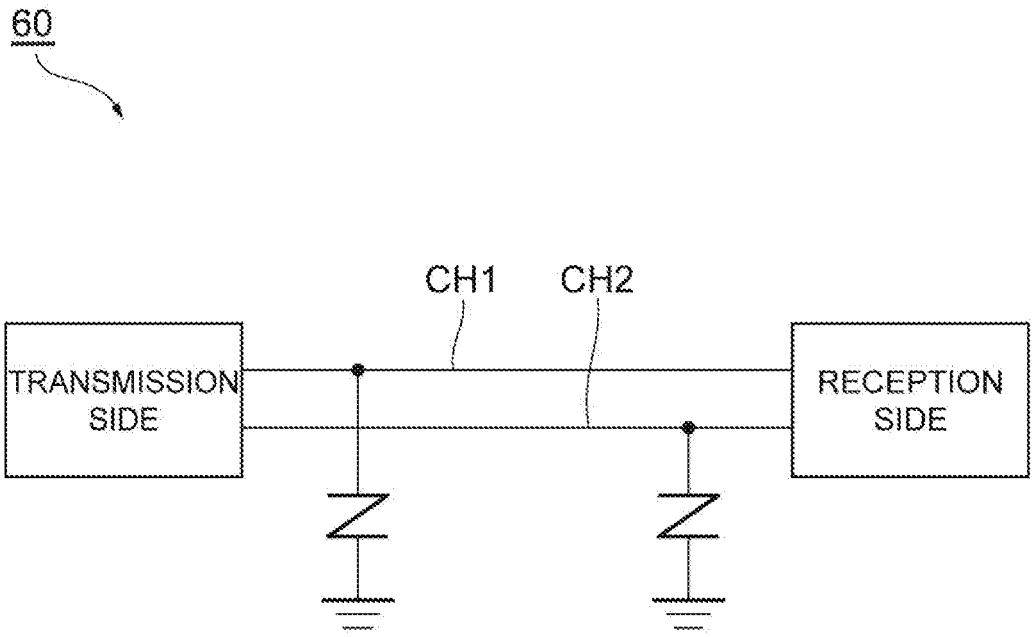
FIG. 6 is a view illustrating a differential transmission transceiver according to a technology in the related art.

As illustrated in FIG. 6, in a differential transmission transceiver 60 according to a technology in the related art, varistor elements differing from each other are applied to two channels CH1 and CH2, respectively. Therefore, variations in capacitance are likely to occur between two varistor elements, so that it is difficult to reduce communication errors caused by variations in capacitance.

In the chip varistor 1, as illustrated in FIGS. 3 and 4, a distance A from a position the alkali metal containing portion 12 reaches to the superposition portion 40 along the interface between the first conductor 32 and the element body 10 and the distance A from the position the alkali metal containing portion 12 reaches to the superposition portion 40 along the interface between the second conductor 34 and the element body 10 are longer than a distance B from the position the alkali metal containing portion 12 reaches to the superposition portion 40 along the interface between the third conductor 36 and the element body 10. In the chip varistor 1, the alkali metal containing portion 12 to which heat is relatively unlikely to be transferred is provided along the entire outer surfaces 10*a* to 10*f*. Heat dissipation of heat inside the element body 10 via the third conductor 36 is promoted by performing design such that the distance B is shorter than the distance A, and thus malfunction and deterioration of the chip varistor 1 can be curbed.

In addition, in the chip varistor 1, in the facing direction of the side surfaces 10*e* and 10*f*, a ratio (C/C') of the length C of the first conductor 32 and the second conductor 34 to a length C' of the element body 10 is within a range of 0.1 to 0.6. Therefore, the chip varistor 1 has high ESD resistance and has high reliability.

In order to achieve a suitable ratio C/C', the inventors prepared a plurality of samples in which the first conductor 32 and the second conductor 34 were varied in width and performed an experiment in which a varistor voltage $V_{1mA}$ [V] and an ESD tolerance dose [kV] were measured for each of the samples. Regarding the ESD tolerance dose, based on an electrostatic discharge immunity test defined in the standard IEC 61000-4-2 of the International Electrotechnical Commission (IEC), change in varistor voltage $V_{1mA}$, when a discharge voltage (application voltage) was varied, was measured. Experimental results were as shown in the table of FIG. 7.

As shown in the table of FIG. 7, in the experiment, eight samples (that is, a sample 1 having a width of 0.06 mm, a sample 2 having a width of 0.1 mm, a sample 3 having a width of 0.2 mm, a sample 4 having a width of 0.4 mm, a sample 5 having a width of 0.6 mm, a sample 6 having a width of 0.7 mm, a sample 7 having a width of 0.8 mm, and a sample 8 having a width of 0.9 mm) were prepared. Regarding the varistor voltage $V_{1mA}$, sufficiently low values were obtained in the samples 1 to 6, but high values were obtained in the samples 7 and 8. Regarding the ESD tolerance dose, sufficiently high values were obtained in the samples 2 to 6, but low values were obtained in the samples 1, 7, and 8. From these results, it was found that high ESD resistance and high reliability could be achieved in the samples 2 to 6 in which the ratio C/C' was within a range of 0.1 to 0.6.

In the chip varistor 1, regarding the facing direction of the end surfaces 10*a* and 10*b*, a ratio (D/D') of a length D of the third conductor 36 to lengths D' of the third electrodes 20C and 20D is within a range of 0.2 to 0.6. Therefore, the chip varistor 1 has high ESD resistance and has high reliability.

In order to achieve a suitable ratio D/D', the inventors prepared a plurality of samples in which the third conductor 36 was varied in width and performed an experiment in which the varistor voltage $V_{1mA}$ [V] and the ESD tolerance dose [kV] were measured for each of the samples. Experimental results were as shown in the table of FIG. 8.

As shown in the table of FIG. 8, in the experiment, nine samples (that is, a sample 1 having a width of 0.03 mm, a sample 2 having a width of 0.06 mm, a sample 3 having a width of 0.1 mm, a sample 4 having a width of 0.12 mm, a sample 5 having a width of 0.16 mm, a sample 6 having a width of 0.18 mm, a sample 7 having a width of 0.2 mm, a sample 8 having a width of 0.24 mm, and a sample 9 having a width of 0.3 mm) were prepared. Regarding the varistor voltage $V_{1mA}$, sufficiently low values were obtained in the samples 1 to 7, but low values were obtained in the samples 8 and 9. Regarding the ESD tolerance dose, sufficiently high values were obtained in the samples 3 to 9, but low values were obtained in the samples 1 and 2. From these results, it was found that high ESD resistance and high reliability could be achieved in the samples 3 to 7 in which the ratio D/D' was within a range of 0.2 to 0.6.

Hereinabove, an embodiment of the present disclosure has been described. However, the present disclosure is not necessarily limited to the embodiment described above, and various changes can be made within a range not departing from the gist thereof.

For example, external dimensions of the chip varistor, external dimensions of the element body, and the like can be increased or decreased suitably. In addition, the dimensions of each of the conductors and each of the terminal electrodes can also be increased or decreased suitably. Moreover, materials constituting the element body, each of the conductors, and each of the terminal electrodes can be suitably changed to known materials which can be applied to chip varistors.

What is claimed is:

1. A chip varistor comprising:

an element body having a first surface and a second surface facing each other and having a laminated structure;

a first conductor extending within a predetermined layer of the element body in a facing direction, the first surface and the second surface face each other in the facing direction;

a second conductor extending within a layer different from the layer of the first conductor of the element body in the facing direction, and forming a superposition portion superposed on the first conductor in a lamination direction of the element body;

a third conductor extending within a layer positioned in the middle between the first conductor and the second conductor of the element body in a direction intersecting the first conductor and the second conductor, having a functional portion superposed on the superposition portion in the lamination direction of the element body, forming a first functional layer between the functional portion and the first conductor, and forming a second functional layer between the functional portion and the second conductor;

a first electrode provided on the first surface side of the element body and connected to the first conductor;

a second electrode provided on the second surface side of the element body and connected to the second conductor;

a third electrode provided on a surface of the element body and connected to the third conductor; and an alkali metal containing portion serving as a part of the element body, an electrical resistance of the alkali metal containing portion has been enhanced due to an alkali metal being contained, the alkali metal containing portion constituting the surface of the element body, and the alkali metal containing portion extending inward from the surface of the element body along interfaces between the first conductor, the second conductor, and the third conductor, and the element body, wherein the alkali metal containing portion does not reach the first functional layer and the second functional layer.

2. The chip varistor according to claim 1, wherein a distance from a position the alkali metal containing portion reaches along the interface between the first conductor and the element body to the superposition portion and a distance from the position the alkali metal containing portion reaches along the interface between the second conductor and the element body to the superposition portion are longer than a distance from the position the alkali metal containing portion reaches along the interface between the third conductor and the element body to the superposition portion.

3. The chip varistor according to claim 1, wherein in a direction orthogonal to the lamination direction and the facing direction of the first surface and the second surface, a ratio of a length of the first conductor and a length of the second conductor to a length of the element body is within a range of 0.1 to 0.6.

4. The chip varistor according to claim 1, wherein in the facing direction of the first surface and the second surface, a ratio of a length of the third conductor to a length of the third electrode is within a range of 0.2 to 0.6.

5. The chip varistor according to claim 1, wherein in the facing direction of the first surface and the second surface, a length of the functional portion of the third conductor is shorter than a length of the superposition portion.

6. A differential transmission transceiver comprising:

the chip varistor according to claim 1, wherein the first electrode of the chip varistor is connected to one channel, the second electrode is connected to the other channel, and the third electrode is earthed.

* * * * *